US008813516B2

(12) United States Patent
Min et al.

(10) Patent No.: US 8,813,516 B2
(45) Date of Patent: Aug. 26, 2014

(54) REFRIGERATOR WITH VISIBLE LIGHT RADIATION

(75) Inventors: Deul Re Min, Seoul (KR); Eun Jeong Kim, Changwon-si (KR); Jong Min Shin, Busan (KR); Seok Min Lim, Jinju-si (KR); Yeon Yi Hwang, Busan (KR); Sang Ho Oh, Daegu (KR); Eun Young Park, Ulsan (KR)

(73) Assignee: LG Electronics Inc., Seoul (KR)

( * ) Notice: Subject to any disclaimer, the term of this patent is extended or adjusted under 35 U.S.C. 154(b) by 1406 days.

(21) Appl. No.: 12/091,909

(22) PCT Filed: Oct. 27, 2006

(86) PCT No.: PCT/KR2006/004418

§ 371 (c)(1), (2), (4) Date: Aug. 11, 2008

(87) PCT Pub. No.: WO2007/049937

PCT Pub. Date: May 3, 2007

(65) Prior Publication Data

US 2008/0307818 A1 Dec. 18, 2008

(30) Foreign Application Priority Data

Oct. 27, 2005 (KR) ..... 10-2005-0101818
Oct. 2, 2006 (KR) ..... 10-2005-0097116

(51) Int. Cl.
*F25D 23/00* (2006.01)
*A23L 3/36* (2006.01)
*F25D 27/00* (2006.01)

(52) U.S. Cl.
CPC ..... *F25D 27/00* (2013.01); *F25D 27/005* (2013.01); *F25D 2400/22* (2013.01)
USPC ..... 62/264; 62/303

(58) Field of Classification Search
CPC .... F25D 27/00; F25D 27/005; F25D 2400/22
USPC ..... 62/264, 441, 303
See application file for complete search history.

(56) References Cited

U.S. PATENT DOCUMENTS 3,717,009 A * 2/1973 Butts ..... 62/523
3,766,976 A * 10/1973 Gelbard et al. ..... 165/122
4,954,465 A * 9/1990 Kawashima et al. ..... 502/5
5,040,856 A * 8/1991 Wilkins et al. ..... 312/402
5,369,415 A 11/1994 Richard et al.

(Continued)

FOREIGN PATENT DOCUMENTS

CN 2639813 Y 9/2004
EP 0 476 724 A2 3/1992

(Continued)

*Primary Examiner* — Alexandra Elve
*Assistant Examiner* — Daniel C Comings
(74) *Attorney, Agent, or Firm* — Birch, Stewart, Kolasch & Birch, LLP

(57) ABSTRACT

A refrigerator is disclosed. The refrigerator includes a main body which has a cooling chamber and a freezing chamber, a storage chamber which is provided in the cooling chamber to store foodstuffs, an irradiation device which irradiates light within a visible light region correspondingly to color of the foodstuffs stored in the storage chamber, an optical deodorization module which includes an ultraviolet light irradiation device which is mounted to the storage chamber to irradiate ultraviolet light and a photocatalyst filter which receives the ultraviolet light from the ultraviolet light irradiation device and is coated with a photocatalyst agent, and a control unit which controls the irradiation device and the ultraviolet light irradiation device.

28 Claims, 18 Drawing Sheets

(56) References Cited

U.S. PATENT DOCUMENTS

| | | | | |
|---|---|---|---|---|
| 5,621,162 | A * | 4/1997 | Yun et al. | 73/23.34 |
| 6,584,786 | B2 * | 7/2003 | Tavolazzi | 62/125 |
| 2002/0043076 | A1 * | 4/2002 | Hodosh et al. | 62/457.4 |
| 2003/0076028 | A1 | 4/2003 | Nieda et al. | |
| 2003/0094009 | A1 * | 5/2003 | Park et al. | 62/229 |
| 2003/0151339 | A1 * | 8/2003 | Reed et al. | 312/405 |
| 2006/0042300 | A1 * | 3/2006 | Kim | 62/348 |

FOREIGN PATENT DOCUMENTS

| | | | | | |
|---|---|---|---|---|---|
| JP | 9-28363 | A | | 2/1997 | |
| JP | 09-303939 | A | | 11/1997 | |
| JP | 11-159953 | A | | 6/1999 | |
| JP | 2002-206851 | A | | 7/2002 | |
| JP | 2003-222453 | A | | 8/2003 | |
| JP | 2003-322460 | A | | 11/2003 | |
| JP | 2004-049908 | A | | 2/2004 | |
| JP | 2005-49093 | A | | 2/2005 | |
| JP | 2005-65622 | A | | 3/2005 | |
| JP | 2006-65622 | A | * | 3/2005 | A23B 7/00 |
| KR | 1999-007064 | U | | 2/1999 | |
| KR | 10-2002-0001472 | | | 1/2002 | |
| KR | 10-2005-0045043 | | | 5/2005 | |
| KR | 10-2006-0018072 | | | 2/2006 | |

* cited by examiner

REFRIGERATOR WITH VISIBLE LIGHT RADIATION

TECHNICAL FIELD

The present invention relates to a refrigerator, and more particularly to a refrigerator which can store vegetables and fruits or meats and fishes in a more fresh state.

BACKGROUND ART

Generally, a refrigerator comprises a freezing chamber and a cooling chamber. A storage chamber is separately provided at a specific location in the cooling chamber so as to store vegetables and fruits (hereinafter, which will be commonly called "vegetables") or meats and fishes in a more fresh state by optimizing humidity. Therefore, the storage chamber in the cooling chamber may be an example of a foodstuffs storage container.

A conventional refrigerator having a foodstuffs storage container will now be described with reference to FIG. 1.

The conventional refrigerator illustrated in FIG. 1 is a refrigerator disclosed in Japanese Patent Laid-open Publication No. 9-28363. As shown in the drawing, a foodstuffs storage container 2 is provided at a top-mount type refrigerator in which a freezing chamber is positioned at an upper portion and a cooling chamber is positioned at a lower portion.

Many factors, such as temperature, humidity, environmental gas, microbe, light and etc., do influence on the freshness of vegetables. Because vegetables perform breathing and transpiration continuously, it is necessary to restrain the breathing and the transpiration in order to maintain the freshness of vegetables. Most vegetables, except for some kinds of vegetables that have trouble at low temperature, restrain the breathing at low temperature and the transpiration at high humidity.

For this reason, a general home refrigerator is provided with a foodstuffs storage container for exclusively storing vegetables as an independent space from the cooling chamber, so as to store vegetables in a fresh state for a long period. The foodstuffs storage container is kept at adequately low temperature and as high humidity as possible by moisture transpired from vegetables. Accordingly, the vegetables can be stored in the foodstuffs storage container in a fresh state for a long time.

Meanwhile, research of a method of maintaining the freshness of vegetables by using the light (another influential factor concerning the freshness of vegetables) is being pursued.

Relatively strong light has a bad influence of promoting color change and transpiration of vegetables, and relatively weak light has an effect of improving the maintenance of the freshness of vegetables. Also, weak light restrains chlorophyll degradation of green leaf and stem vegetables, and has an effect of keeping in vitamin C.

A refrigerator 1 illustrated in FIG. 1 is provided with an irradiation device 6 which irradiates weak light into the foodstuffs storage container 2, so as to prevent decrease of chlorophyll concentration of green leafy and stem vegetables, and resultantly prevent deterioration of the quality of leafy and stem vegetables. An illuminating lamp 8 is provided over the drawer-type foodstuffs storage container 2. When the drawer-type foodstuffs storage container 2 is opened, the illuminating lamp 8 emits light to allow a user to easily see the foodstuffs in a storage chamber 4. When the drawer-type foodstuffs storage container 2 is closed, the irradiation device 6 irradiates weak light to prevent deterioration of the quality if green leafy and stem vegetables.

Japanese Patent Laid-open Publication No. 11-159953 discloses a refrigerator provided with the irradiation device which is embodied by a light emitting diode (LED) which emits light within a visible light region. Accordingly, heat generation from the irradiation device is minimized, rise of temperature in the storage chamber is prevented, and irradiating efficiency is increased as compared to other irradiation devices.

Also, Japanese Patent Laid-open Publication No. 2005-49093 discloses a refrigerator provided with a red LED which emits light of a wavelength of about 660 nm to green leafy and stem vegetables.

And, Japanese Patent Laid-open Publication No. 2005-65622 discloses a refrigerator provided with a foodstuffs storage container which is partitioned into several storage chambers and irradiation devices which irradiate light of adequate wavelengths for kinds C vegetables stored in the storage chambers. More particularly, three color (red, blue and green) LEDs are used as a light source, and emitting colors of the light from the three color LEDs can be selectively combined according to the kinds of vegetables.

However, the above conventional refrigerator having the foodstuffs storage container has problems as follows.

The emitting colors of the light from the three color (red, blue, green) LEDs can be selectively combined, but it is not accurate that which of the red LED, the blue LED and the green LED respectively are effective to which foodstuffs. Therefore, such an irradiation device is not effective to the maintenance of the freshness of the stored foodstuffs and the prevention of the chlorophyll degradation.

Although the foodstuffs storage container is partitioned into several storage chambers, because a reference, by which the user classifies the foodstuffs and separately puts the classified foodstuffs into the storage chambers, is not clear, there is no effectiveness in partitioning the foodstuffs storage container into several storage chambers.

Also, means for selecting the emitting colors of the light from the three color LEDs is provided at the conventional irradiation device, but the selecting means is not practical due to lack of accurate information that which emitting color is most adequate for which foodstuffs. Although it is found that which emitting color is most effective to which foodstuffs by experiments, it is very difficult for the user to remember this information one by one to select the emitting color, or it is very troublesome for the user to search this information before selecting the emitting color.

Further, regarding the foodstuffs, the relationship of which with the emitting color is not experimentally found, the user cannot determine which emitting color is adequate or the foodstuffs and cannot be confident whether the user-selected emitting color is adequate for the foodstuffs or not. Thus, the user comes to distrust the irradiation device.

In order to keep the foodstuffs in a more fresh state for a long period, the humidity in the cooling chamber is set as high as possible. However, the higher the humidity is, the more various germs propagate in the cooling chamber. Also, the air of the cooling chamber is impregnated with a bad smell.

DISCLOSURE OF INVENTION

Technical Problem

Accordingly, the present invention is directed to a refrigerator that substantially obviates one or more problems due to limitations and disadvantages of the related art.

An object of the present invention devised to solve the problem lies on a refrigerator which can keep foodstuffs in a more fresh state for a long period by irradiating visible light of a specific wavelength into a storage chamber.

Another object of the present invention devised to solve the problem lies on a refrigerator which can detect a value indicating freshness of foodstuffs stored in a storage chamber, and transmit warning message to a user or automatically freeze the foodstuffs when the detected value is a predetermined limit value or more.

A yet another object of the present invention devised to solve the problem lies on a refrigerator which can keep meats and fishes in a fresh state by repeatedly irradiating ultraviolet light into a storage chamber with a predetermined period.

Technical Solution

The object of the present invention can be achieved by providing a refrigerator comprising: a main body which has a cooling chamber and a freezing chamber; a storage chamber which is provided in the cooling chamber to stoke foodstuffs; an irradiation device which irradiates light within a visible light region correspondingly to color of the foodstuffs stored in the storage chamber; an optical deodorization module which includes an ultraviolet light irradiation device which is mounted to the storage chamber to irradiate ultraviolet light and a photocatalyst filter which receives the ultraviolet light from the ultraviolet light irradiation device and is coated with a photocatalyst agent; and a control unit which controls the irradiation device and the ultraviolet light irradiation device.

The ultraviolet light irradiation device may include ultraviolet light emitting diodes.

The photocatalyst filter may be mounted to the storage chamber. The photocatalyst filter may be formed in a mesh type which is coated with a titanium dioxide photocatalyst solution, or may be formed in a plate type which is coated with a titanium dioxide photocatalyst solution and formed with a plurality of through-holes.

The irradiation device may be a light emitting diode.

The control unit may control the irradiation device to irradiate light having different emitting colors into the storage chamber.

The irradiation device may be configured to irradiate light having color of combining white and one color selected from red and green.

Also, the control unit may control the irradiation device to irradiate light within the visible light region correspondingly to the color of the foodstuffs stored in the storage chamber.

The refrigerator may further comprise an input part for inputting information of the color if the foodstuffs stored in the storage chamber. The control unit controls the irradiation device to irradiate light within the visible light region correspondingly to the color of the foodstuffs according to the information inputted to the input part.

Preferably, when the information of the color of the foodstuffs inputted to the input part is red, the control unit controls the irradiation device to irradiate red light. When the information if the color of the foodstuffs inputted to the input part is green, the control unit controls the irradiation device to irradiate green light.

The refrigerator may further comprise a color recognition device which recognizes the color of the foodstuffs stored in the storage chamber. The control unit controls the irradiation device to irradiate light within the visible light region correspondingly to the color of the foodstuffs in response to a signal from the color recognition device.

In another aspect of the present invention, there is provided a refrigerator comprising: a main body which has a cooling chamber and a freezing chamber; a meats/fishes storage chamber which is provided in the cooling chamber and coated with antimicrobial material to prevent microbial propagation; a visible light irradiation device which irradiates visible light into the meats/fishes storage chamber; and a control unit which controls the irradiation device.

The visible light irradiation device may include at least one tight emitting diode.

The visible light irradiation device may irradiate light of any one emitting color selected from the group consisting of blue, red-blue combined color and yellow-white combined color into the meats/fishes storage chamber.

The visible light irradiation device may irradiate yellow-white combined light into the meats/fishes storage chamber.

The antimicrobial material may be titanium dioxide.

The refrigerator may further comprise: a freshness measuring device which detects a value indicating freshness of meats and fishes stored in the meats/fishes storage chamber; a display part which displays the freshness of the meats and fishes measured by the freshness measuring device; and an ultraviolet light irradiation device which irradiates ultraviolet light into the meats/fishes storage chamber. The control unit controls the display part and the ultraviolet light irradiation device.

The freshness measuring device may be a volatile basic nitrogen (VBN) sensor or an infrared sensor.

The control unit may control the ultraviolet light irradiation device to irradiate ultraviolet light into the meats/fishes storage chamber with a predetermined period.

The control unit may be connected to the freshness measuring device, and when the value detected by the freshness measuring device is a specific limit value or more, although an operating state of the ultraviolet light irradiation device does not correspond to a light emitting mode, the control unit may control the ultraviolet light irradiation device to irradiate ultraviolet light.

The refrigerator may further comprise a cooling device which cools the meats/fishes storage chamber. The control unit may control the cooling device.

The control unit may control the cooling device to keep the meats/fishes storage chamber at a temperature of −1.5° C. to −2.5° C., preferably −2.0° C.

The cooling device may include a first heat sink which is mounted in the freezing chamber, and a second heat sink which is mounted in the cooling chamber and connected to the first heat sink, the second heat sink being kept below a predetermined temperature by cool air transferred from the first heat sink and supplying the cool air into the meats/fishes storage chamber.

The first heat sink and the second heat sink may be formed in a plate type or a pin type.

Also, the second heat sink may be positioned above the meats/fishes storage chamber.

When the value detected by the freshness measuring device is a predetermined limit value or more, the control unit may control the display part to display a warning message.

Also, the refrigerator may further comprise a cooling device which cools the meats/fishes storage chamber. When the value detected by the freshness measuring device is a predetermined limit value or more, the control unit may control the cooling device to freeze the meats and fishes stored in the meats/fishes storage chamber.

Also, the refrigerator may further comprise a cooling device which cools the meats/fishes storage chamber. When the value detected by the freshness measuring device is a predetermined first limit value or more, the control-unit may control the display part to display a warning message, and when the value detected by the freshness measuring device is a predetermined second lint value or more, the control unit may control the cooling device to freeze the meats and fishes stored in the meats/fishes storage chamber.

Advantageous Effects

The refrigerator according to the present invention has the following effects.

the refrigerator according to the present invention is configured to separately store the foodstuffs classified by colors and irradiate the most adequate light or the color of the stored foodstuffs, thereby maximizing the effects of maintaining the freshness of the foodstuffs and preventing the decrease of chlorophyll concentration.

Also, the refrigerator presents the user with the clear reference by which the foodstuffs are classified and stored in the respective storage chambers. Therefore, the effect of partitioning the foodstuffs storage container into a plurality of storage chambers can be increased.

Also, since the user can input the information of the color of the stored foodstuffs, the emitting color of the light irradiated to the stored foodstuffs is selected adequately for the color of the foodstuffs.

Also, because the clear and intuitive reference for selecting the emitting color of the light irradiated to the stored foodstuffs is provided, the user can easily select the emitting color of the light and trust the effects by the irradiation device.

Also, because the optical deodorization module sterilizes and deodorizes the air in the foodstuffs storage chambers, the effect of maintaining the freshness of the foodstuffs can be increased.

Also, because the visible light is irradiated into the meats/fishes storage chamber and the meats/fishes storage chamber is controlled to be kept at a predetermined temperature, the meats and fishes can be stored in a more fresh state in the meats/fishes storage chamber for a long period.

Also, when the detected value indicating the freshness of the meats and fishes is the first limit value or more, the control unit transmits the warning message to the user, and when the detected value is the second limit value or more, the control unit controls the cooling device to freeze the meats and fishes stored in the meats/fishes storage chamber, thereby preventing further deterioration of the freshness.

Also, by irradiating ultraviolet light into the meats/fishes storage chamber with a predetermined period, deterioration if the freshness of the meats and fishes can be additionally prevented.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
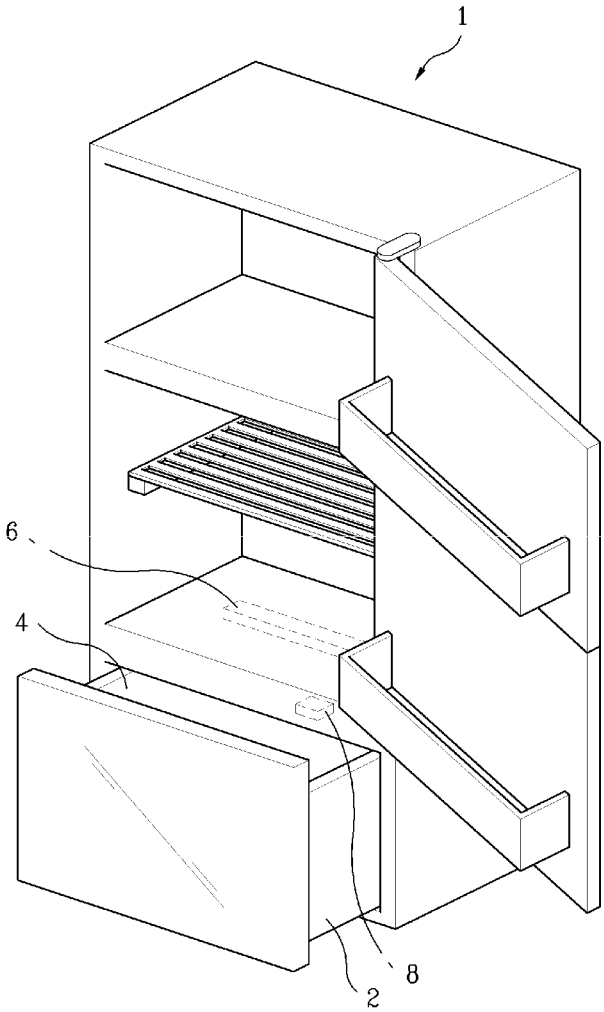
FIG. 1 is a perspective view showing a conventional refrigerator.
Figure 2:
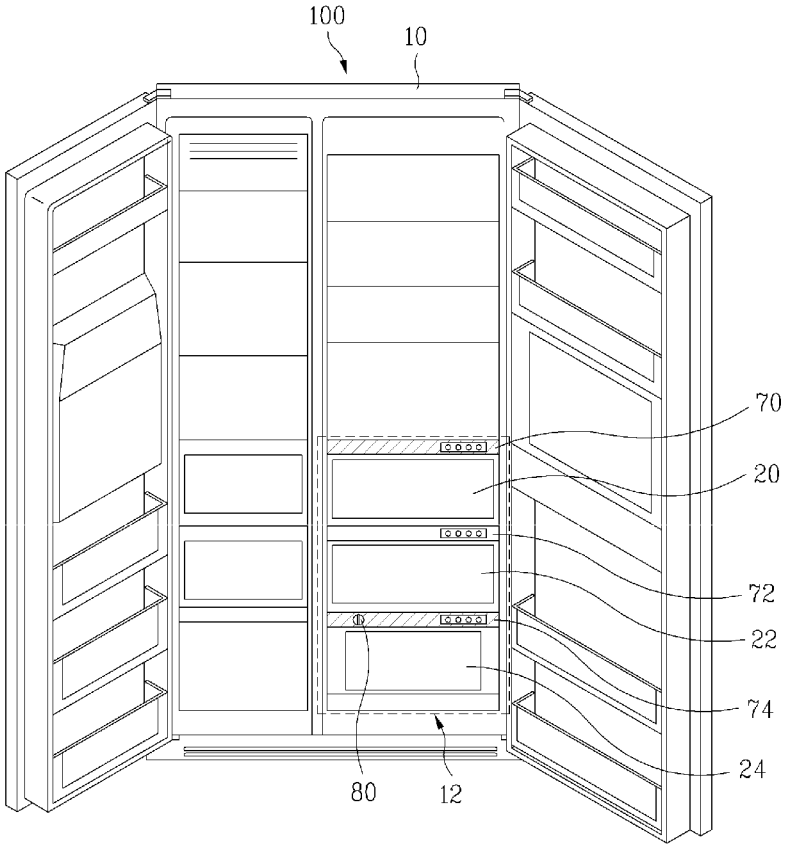
FIG. 2 is a front view showing a refrigerator having a foodstuffs storage chamber in accordance with a first embodiment of the present invention.
Figure 3:
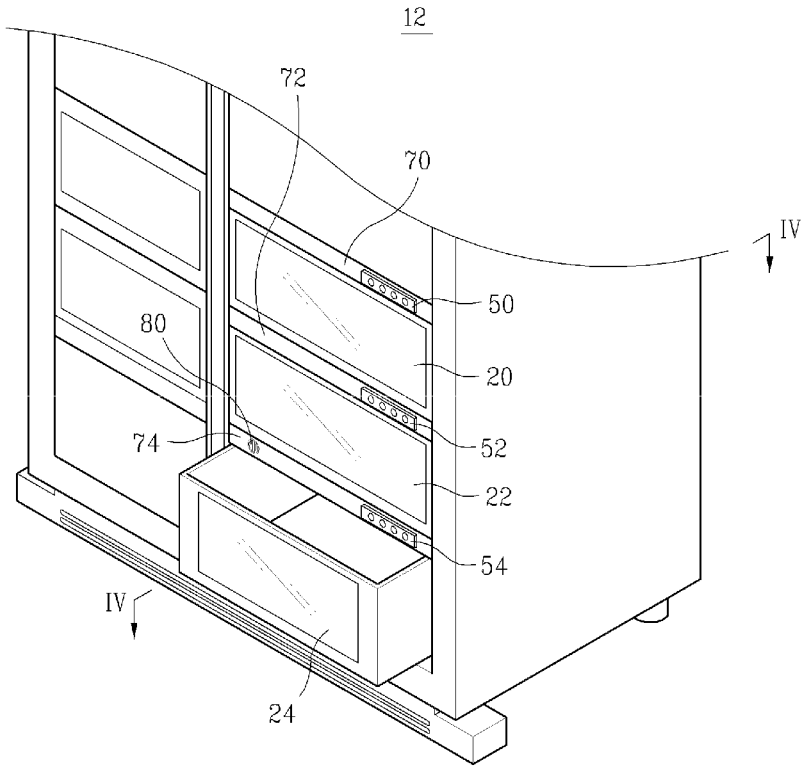
FIG. 3 is an enlarged perspective view showing a foodstuffs storage chamber in FIG. 2.

FIG. 2 is a front view showing a refrigerator having a foodstuffs storage chamber in accordance with a first embodiment of the present invention, and FIG. 3 is an enlarged perspective view showing a foodstuffs storage chamber in FIG. 2.

Referring to FIGS. 2 and 3, a refrigerator 100 according to a first embodiment of the present invention comprises a main body 10 having a cooling chamber, and a foodstuffs storage container 12 which is provided in the main body 10 and executes an optical deodorization by selectively irradiating light within a visible light region according to a color of the foodstuffs stored in the foodstuffs storage container 12.

This embodiment exemplarily illustrates that the foodstuffs storage container of the present invention is applied to a side-by-side type refrigerator in which a cooling chamber and a freezing chamber are partitioned in left and right directions. In particular, the cooling chamber is formed at a right portion of the main body, the freezing chamber is formed at a left portion of the main body, and the foodstuffs storage container is provided at a lower portion of the cooling chamber.

The foodstuffs storage container according to the present invention includes a plurality of storage chambers 20, 22 and 24, and irradiation devices and ultraviolet light irradiation devices which are mounted to the respective storage chambers. The plurality of storage chambers 20, 22 and 24 provide foodstuffs storage space, and are defined by a bottom wall and left and right side walls. In his embodiment, the storage chambers 20, 22 and 24 are opened and closed by a sliding type so that the user easily puts or pulls foodstuffs into/out of the storage chambers 20, 22 and 24.

However, the opening/closing type of the storage chambers 20, 22 and 24 is not limited to the sliding typo, and can be variously modified into other types like a door hingedly coupled to an upper portion of the storage chambers 20, 22 and 24.

In order to prevent moisture from leaking, it is preferable to form the foodstuffs storage container 12 to be kept in an airtight state. By the airtight structure of the storage chambers 20, 22 and 24, humidity in the storage chambers 20, 22 and 24 can be adequately maintained by moisture transpired from the foodstuffs.

In this embodiment, there provided are a plurality of storage chambers 20, 22 and 24. In particular, the foodstuffs storage container 12 is constituted by three storage chambers 20, 22 and 24 which are partitioned in a vertical direction. At least one of the storage chambers 20, 22 and 24 is provided with a temperature adjusting device 80 for adjusting temperature in the storage chambers 20, 22 and 24, so as to selectively store meats and vegetables.

Figure 4:
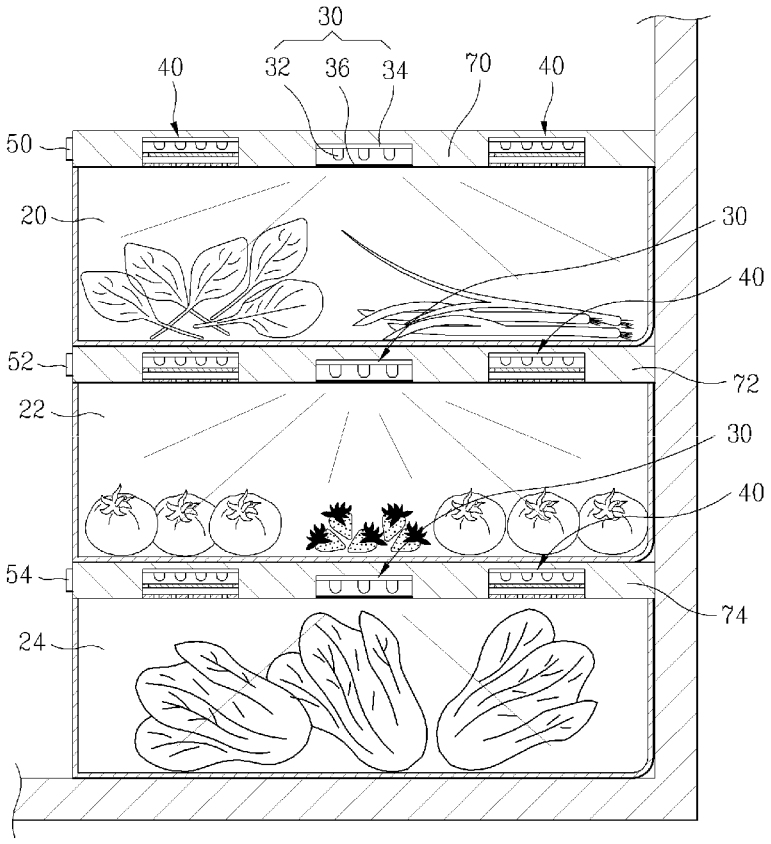
FIG. 4 is a sectional view taken along line IV-IV in FIG. 3.

FIG. 4 is a sectional view taken along line IV-IV in FIG. 3, which shows irradiation devices and ultraviolet light irradiation devices mounted in the respective storage chambers 20, 22 and 24.

Referring to FIG. 4, irradiation devices 30 irradiate light within the visible light region into the respective storage chambers 20, 22 and 24.

For reference, visible light means light which has a wavelength range, of about 380 to 770 nm, which is commonly visible to a person's eyes. The change of nature of the visible light according to the wavelength is represented by a color. That is, as it progresses from red to violet, the wavelength becomes shorter. For example, the wavelength of red light is in the range of 700~610 nm, the wavelength of orange light is 610~590 nm, the wavelength of yellow light is 590~570 nm, the wavelength of green light is 570~500 nm, the wavelength of blue light is 500~450 nm, and the wavelength of violet light is 450~400 nm.

When the infrared light, which has a wavelength longer than 770 nm is irradiated, the temperature in the storage chambers 20, 22 and 24 and the surface temperature of the stored foodstuffs are increased. Thus, the surface of the foodstuffs is discolored and the foodstuffs deteriorate quickly. For this reason, it is preferable that the irradiation device 30 is designed to emit light within the visible light region.

Because the red visible light region is not accurately discriminated from the infrared light region and the violet visible light region is not accurately discriminated from the ultraviolet light region, the visible light region defined in the present invention includes a partial infrared light region which has the range of the wavelength near the wavelength of the red visible light region and a partial ultraviolet light region which has the range of the wavelength near the wavelength of the violet visible light region.

Each of the irradiation devices 30 includes a substrate 34, a light emitting element 32 mounted to the substrate 34, and a protective cover 36 for preventing permeation of moisture into the light emitting element 32 and damage of the light emitting element 32.

Any light source may be used as a light emitting element 32. However, it is preferable that the light emitting element 32 is embodied by a light emitting diode (LED) which has relatively low heat generation and relatively high light emitting efficiency. By using the LED as the light emitting element 32, the heat generated from the irradiation device 30 is minimized, and the rise of the temperature by the light emitting element 32 is decreased. Accordingly, the irradiation device 30 can be driven with relatively low power consumption.

Meanwhile, a control unit (not shown) may control the irradiation devices 30 to irradiate light having different emitting colors into the storage chambers 20, 22 and 24 according to the colors of the foodstuffs stored in the storage chambers 20, 22 and 24.

By experiments, the applicant of the present invention has found that when the emitting color of the irradiation device matches with the color of the stored foodstuffs, it is most effective to the maintenance of freshness of the foodstuffs and nutritive elements. For example, the red light is irradiated to red foodstuffs, and the green light is irradiated to green foodstuffs.

Based on the above facts, this embodiment is structured such that many kinds of foodstuffs are classified by colors and the emitting color of light irradiated to foodstuffs is changed according to the color of foodstuffs. More particularly, when the color of the stored foodstuffs is red, the irradiation device 30 is set to irradiate the red light to the stored foodstuffs, and when the color of the stored foodstuffs is green, the irradiation device 30 is set to irradiate the green-white combined light to the stored foodstuffs. Especially, the applicant of the present invention has found by the experiments that it is more effective to the maintenance of the freshness and the prevention of decrease of chlorophyll concentration of foodstuffs to irradiate green-white combined light to green foodstuffs rather than to irradiate pure green light.

The foodstuffs stored in the foodstuffs storage container 12 may be primarily classified into vegetables and fruits. Further, the vegetables may be classified into leafy and stem vegetables, leaves and/or stems of which are used, root vegetables, roots and/or subterranean stems of which are used, and furit vegetables, fruits of which are used. In the present invention, the above various kinds of vegetables and fruits are classified by red and green, and the irradiation device is set to irradiate light of different emitting colors to the classified foodstuffs. For example, strawberry, tomato, plum or the like belong to the red foodstuffs, and spinach, Chinese cabbage, cabbage or the like belong to the green foodstuffs.

The applicant of the present invention has performed an experiment of classifying the foodstuffs by red and green, irradiating red light to the red foodstuffs by use of the red LED, irradiating green-white combined light to the green foodstuffs by use of the green LED and the white LED, and measuring the variation of freshness of the stored foodstuffs after a predetermined period.

According to the experimental results, discoloration and dryness phenomena were considerably decreased in the green foodstuffs, and mold and tenderness phenomenon were almost not generated in the red foodstuffs, as compared to the case if indiscriminately irradiating visible light by use of the white LED.

FIG. 4 shows an example of classifying the foodstuffs by colors and separately storing the classified foodstuffs in the storage chambers 20, 22 and 24. More particularly, Chinese cabbage and green onion belonging to the green foodstuffs classification are stored in the first storage chamber 20 which is located at an uppermost position of the storage chambers, tomato and strawberry belonging to the red foodstuffs classification are stored in the second storage chamber 22 which is located at a middle position, and cabbage belonging to the green foodstuffs classification is stored in the third storage chamber 24 which is located at a lowermost position.

The mounting positions of the irradiation devices 30 have no limitation. The irradiation devices 30 can be selectively mounted to the upper portions and the lower portions of the storage chambers 20, 22 and 24. In this embodiment, it is illustrated in FIG. 4 that the irradiation devices 30 are mounted to the upper portions of the storage chambers 20, 22 and 24, however, this is not restricted thereto.

Optical deodorization modules 40 are mounted to the storage chambers 20, 22 and 24 while opposing the inside of the storage chambers 20, 22 and 24. Each of the optical deodorization modules 40 includes ultraviolet light irradiation devices 41 (see FIG. 5) which are mounted to the storage chambers 20, 22 and 24 to irradiate ultraviolet light, and a photocatalyst filter 43 (see FIG. 5) which is mounted in front of the ultraviolet light irradiation devices 41 and coated with a photocatalyst agent.

The ultraviolet light irradiation devices 41 are for emitting ultraviolet light into the storage chambers 20, 22 and 24. As shown in FIG. 4, it is preferable that the ultraviolet light irradiation devices 41 are insertedly mounted in upper panels 70, 72 and 74 so as not to interfere with the foodstuffs stored in the storage chambers 20, 22 and 24, however, this is not restricted thereto. The ultraviolet light irradiation devices 41 can also be selectively mounted to other positions or easily irradiating ultraviolet light into the storage chambers 20, 22 and 24. For example, the ultraviolet light irradiation devices 41 can be mounted in inner left surfaces or inner right surfaces of the storage chambers 20, 22 and 24.

Figure 5:
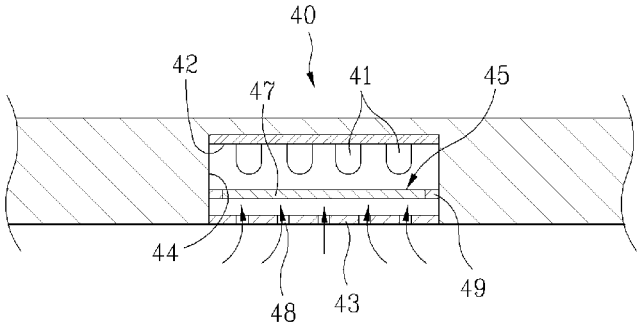
FIG. 5 is a partial sectional view showing an ultraviolet light irradiation device in FIG. 4.

FIG. 5 illustrates the constitution of the optical deodorization module 40 in FIG. 4 in detail.

Referring to FIG. 5, the storage chambers 20, 22 and 24 are respectively formed with an insertion portion 44 in which the ultraviolet light irradiation devices 41 are inserted. A sealing member 45 is mounted to the insertion portion 44 in order to prevent moisture in the storage chambers 20, 22 and 24 from permeating into the ultraviolet light irradiation devices 41. The sealing member 45 includes a first sealing part 47 which is disposed in the insertion portion 44 and allows ultraviolet light to penetrate therethrough, and a second sealing part 49 which is mounted around the first sealing part 47 to seal a gap between the insertion portion 44 and the first sealing part 47. Preferably, the first sealing part 47 is made of glass material, through which ultraviolet light can sufficiently penetrate. Also, the second sealing part 49 is made of rubber material so as to prevent the moisture permeation. The photocatalyst filter 43 is mounted under the sealing member 45. A reference numeral 42 refers to a substrate to which the ultraviolet light irradiation devices 41 are installed.

The ultraviolet light irradiation devices 41 may be embodied by an ultraviolet light LED (UV-LED). Both a low pressure UV-LED and a high pressure UV-LED can be used. In this embodiment, it is preferable that the low pressure UV-LED is used. More particularly, the low pressure UV-LED means a UV-LED which has high energy efficiency and more effectively generates ultraviolet light near the wavelength of 57.7 mm having a strong sterilizing force. Such a low pressure UV-LED has an advantage that a contaminant is not adhered to a surface of the UV-LED because surface temperature of the low pressure UV-LED is low. It is preferable to provide a plurality of UV-LEDs to increase ultraviolet light emitting strength. Of course, the low pressure UV-LED can be substituted by the high pressure UV-LED having a wider ultraviolet light emitting range.

Figure 6:
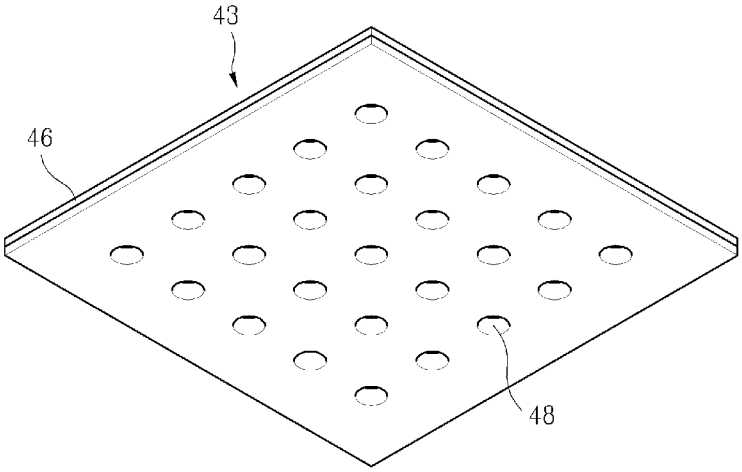
FIG. 6 is a perspective view showing a plate type photocatalyst filter in FIG. 5.

The photocatalyst filter 43 mounted to the insertion portion 44 under the sealing member 47 is illustrated in detail in FIG. 6.

Referring to FIG. 6, the photocatalyst filter 43 is formed in a plate shape which is coated with a titanium dioxide ($TiO_2$) photocatalyst solution 46 and formed with a plurality of through-holes 48. Air in the storage chambers 20, 22 and 24 can flow into the insertion portion 44 through the plurality of through-holes 48 of the photocatalyst filter 43. When the ultraviolet light irradiation devices 41 irradiate ultraviolet light to the photocatalyst filter 43, the photocatalyst filter 43 executes an optical deodorization performance, thereby sterilizing and deodorizing the air in the storage chambers 20, 22 and 24. Describing in detail, when ultraviolet light is irradiated to the titanium dioxide ($TiO_2$) photocatalyst solution 46, the titanium dioxide ($TiO_2$) is divided into electrons (e) and holes ($e^+$) and active species ($O^{2-}$, $OH^-$) are generated, thereby sterilizing and deodorizing the air in the storage chambers 20, 22 and 24 with a strong oxidizing force. Here, the electron generated in the titanium dioxide ($TiO_2$) means that super oxide anions ($O^{2-}$) are generated by the reaction to absorbed oxygen on the surface of the photocatalyst filter 43. And, the hole generated in the titanium dioxide ($TiO_2$) means that hydroxy radicals ($OH^-$) are generated by the reaction to absorbed water on the surface of the photocatalyst filter 43.

Figure 7:
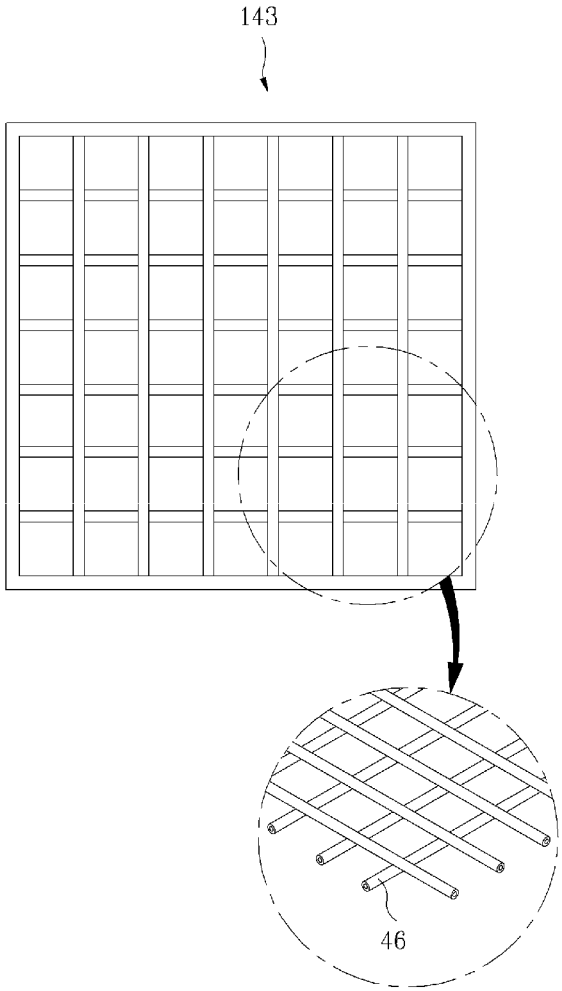
FIG. 7 is a perspective view showing a mesh type photocatalyst filter in FIG. 5.

FIG. 7 shows an exemplary modification (mesh type) of the photocatalyst filter.

A photocatalyst filter 143 depicted in FIG. 7 is formed in a mesh type which is mounted to the insertion portion 44 under the sealing member 47 and coated with the titanium dioxide ($TiO_2$) photocatalyst solution 46. The size of the mesh of the photocatalyst filter 143 is adequately determined so that air in the storage chambers 20, 22 and 24 can flow freely into the insertion portion 44. By the aforesaid optical deodorization performance of the mesh type photocatalyst filter 143, air in the storage chambers 20, 22 and 24 is securely sterilized and deodorized.

The above-described optical deodorization modules 40 are optionally operated by input parts 50, 52 and 54 (see FIG. 3). The input parts 50, 52 and 54, as shown in FIG. 3, are mounted to front portions of the upper panels 70, 72 and 74, respectively.

Figure 8:
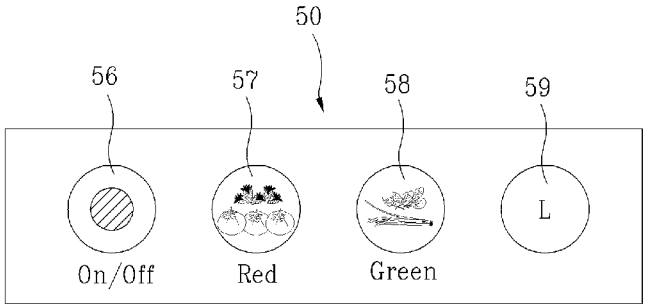
FIG. 8 is a schematic view showing an input part.

FIG. 8 is a front view showing an exemplary constitution if the input parts 50, 52 and 54.

As shown in FIG. 8, each of the input parts 50, 52 and 54 has four buttons, more particularly, a red button 57 (which is subjected to be selected when red foodstuffs are stored in the storage chambers 20, 22 and 24), a green button 58 (which is subjected to be selected when green foodstuffs are stored in the storage chambers 20, 22 and 24), an on/off button 56 for turning on/off the irradiation devices 30, and an optical deodorization button 59 for optionally operating the optical deodorization modules 40. Accordingly, the input parts 50, 52 and 54 allow the user to simultaneously operate the optical deodorization modules 40 and the irradiation devices 30 or selectively operate either the optical deodorization modules 40 or the irradiation devices 30. Also, according to the user's selection by use of, the input parts 50, 52 and 54, the optical deodorization modules 40 and the irradiation devices 30 can be operated alternately with a predetermined period.

Meanwhile, when the user selectively presses the red button 57 or the green button 58 of the input parts 50, 52 and 54, the control unit controls the irradiation devices 30 to change the emitting color of light emitted from the irradiation devices correspondingly to the user-selected color of the foodstuffs, which will be described later in detail.

By the above-described input parts 50, 52 and 54, when the user selects the button for inputting the information whether the color of the stored foodstuffs is red or green, the control unit controls the irradiation devices to change the emitting color of light to green-white combined color from red or change the emitting color of light to red from green-white combined color.

Figure 9:
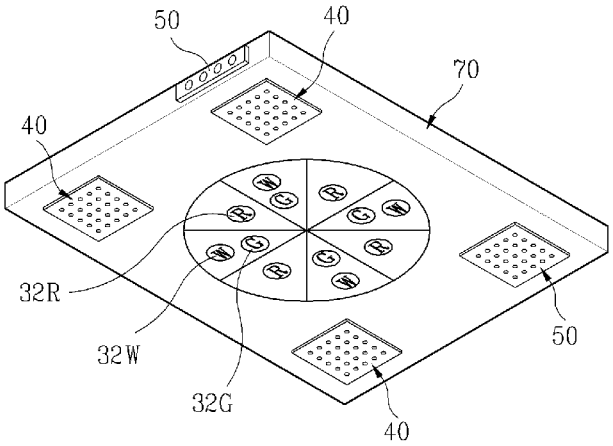
FIG. 9 is a bottom perspective view schematically showing an upper panel in FIG. 4.

FIG. 9 is a bottom perspective view schematically showing the upper panel in FIG. 4.

Referring to FIG. 9, the arrangement of the light emitting elements of the foodstuffs storage container according to the first embodiment will now be described.

The light emitting elements 32 may be positioned and arranged very diversely, however, it is most preferable to dispose and arrange the light emitting elements 32 so as to evenly irradiate light to the stored foodstuffs. FIG. 9 shows an exemplary arrangement of the light emitting elements 32 of the irradiation device mounted to the first storage chamber 20. As shown in FIG. 9, red LEDs 32R, green LEDs 32G and white LEDs 32W are disposed at a center portion of the upper panel 70 provided at an upper portion of the first storage chamber 20. Also, the plurality of optical deodorization modules 40 are mounted to the upper panel 70 around the irradiation device, to thereby securely execute the optical deodorization performance.

Describing in detail, the center portion of the upper panel 70 to which the LEDs are mounted is formed in a circle shape, and the circle-shaped center portion of the upper panel 70 is equiangularly partitioned. The red, green and white LEDs 32R, 32G and 32W are disposed at the respective partitioned fanwise regions. At this time, because the green LED 32G and the white LED 32W are driven together to irradiate light to the green foodstuffs, the green LED 32G and the white LED 32W are arranged adjacently to each other in the respective fanwise regions. Also, it is preferable to increase an irradiation angle of the light emitting elements so as to evenly irradiate light to all stored foodstuffs.

When the user presses the red button 57 or the green button 58 of the input part 50 (see FIG. 8), the control unit controls the irradiation device to change the emitting color of light emitted from the LEDs. For example, when the user presses the green button 58 of the input part 50, the control unit turns off the red LEDs 32R and turns on the green LEDs 32G and the white LEDs 32W to irradiate green-white combined light. On the other hand, when the user presses the red button 57 of the input part 50, the control unit turns of the green LEDs 32G and the white LEDs 32W and turns on the red LEDs 32R to irradiate red light.

It is preferable that the foodstuffs storage container 12 is provided with an opening/closing sensor (not shown) for determining whether the storage chambers 20, 22 and 24 are opened or closed. Only when the opening/closing sensor determines that the storage chambers 20, 22 and 24 are closed, the irradiation devices 30 are driven to irradiate light.

Preferably, the refrigerator according to the present invention may further include a color recognition device (not shown) like a compact camera capable of recognizing the color of the foodstuffs stored in the foodstuffs storage container 12. In response to a signal from the color recognition device which detects the color of the stored foodstuffs, the control unit (not shown) controls the irradiation devices 30 to irradiate visible light having the color corresponding to the color of the foodstuffs.

In the above description, it has been explained that the irradiation device of the present invention has the reds green and white LEDs. However, the irradiation device may be configured to have blue and yellow LEDs.

Figure 10:
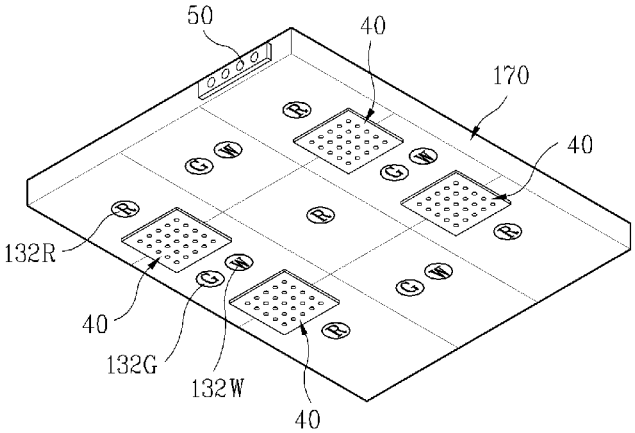
FIG. 10 is a bottom perspective view showing an exemplary modification of an upper panel in FIG. 4.

FIG. 10 is a bottom perspective view showing an exemplary modification of the upper panel. For convenience of description, the upper panel of the first storage chamber 20 which is disposed at the uppermost position will be described as an example.

Referring to FIG. 10, the basic constitution of the upper panel 170 of this embodiment is the same as that of the upper panel 70 of the previous embodiment (see FIG. 9), except that light emitting elements of the irradiation device 30 are not positioned concentratedly at the center portion of the upper panel 170 but are arranged scatteredly with a predetermined distance therebetween on the upper panel 170. A plurality (optical deodorization modules 40 are, mounted to the upper panel 170.

In this embodiment, in order to evenly irradiate light to the stored foodstuffs, the red LEDs 132R, and the green and white LEDs 132G and 132W are scatteredly arranged with a predetermined distance therebetween in width and length directions over the upper panel 170 which is provided at the upper portion of the storage chamber 20. As described above, because the green LED 132G and the white LED 132W are driven together to irradiate light to the green foodstuffs, the green LED 132G and the white LED 132W are arranged adjacently to each other in the respective rectangular regions.

Figure 11:
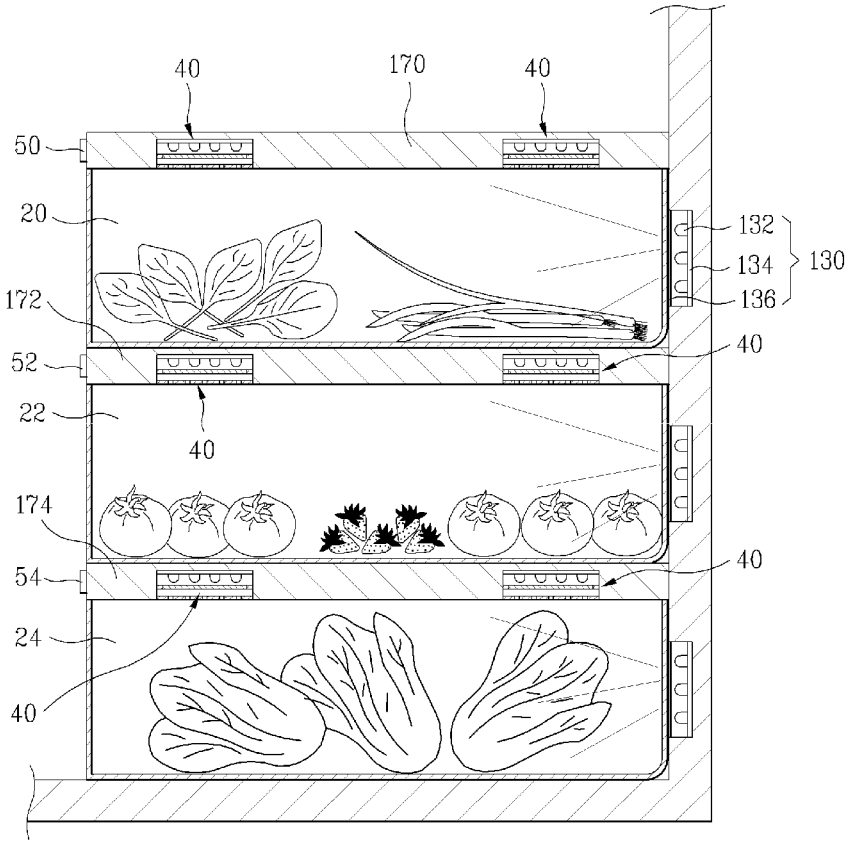
FIG. 11 is a sectional view taken along line IV-IV in FIG. 3, which shows an exemplary modification of a foodstuffs storage container.

FIG. 11 is a sectional view taken along line IV-IV in FIG. 3, which shows an exemplary modification of the foodstuffs storage container where the irradiation devices 130 are not mounted to the upper panels 170.

As shown in FIG. 11, this embodiment is configured such that the irradiation devices 130 are disposed at outer rear portions of the storage chambers 20, 22 and 24. In other words, the irradiation devices 130 are mounted in the rear partition wall of the main body of the refrigerator. Thus, light emitted from the irradiation devices 130 is irradiated into the storage chambers 20, 22 and 24 by penetrating through the side walls of the storage chambers 20, 22 and 24. The side walls of the storage chambers 20, 22 and 24 are made of light permeable material.

Similarly to the previous embodiment illustrated in FIG. 4, the irradiation devices 130 of this embodiment for irradiating light into the respective storage chambers 20, 22 and 24 include substrates 134, light emitting elements 132 mounted to the substrates 134, and protective covers 136 for preventing permeation of moisture into the light emitting elements 132 and damage of the light emitting elements 132.

In the above description, it has been explained that the light emitting elements 132 of the irradiation devices 130 of this embodiment are concentratedly arranged at the outer rear portions of the storage chambers 20, 22 and 24. However, the light emitting elements 132 of the irradiation devices 130 may be scatteredly arranged with a predetermined distance therebetween in width and length directions over the outer rear portions of the storage chambers 20, 22 and 24.

Figure 12:
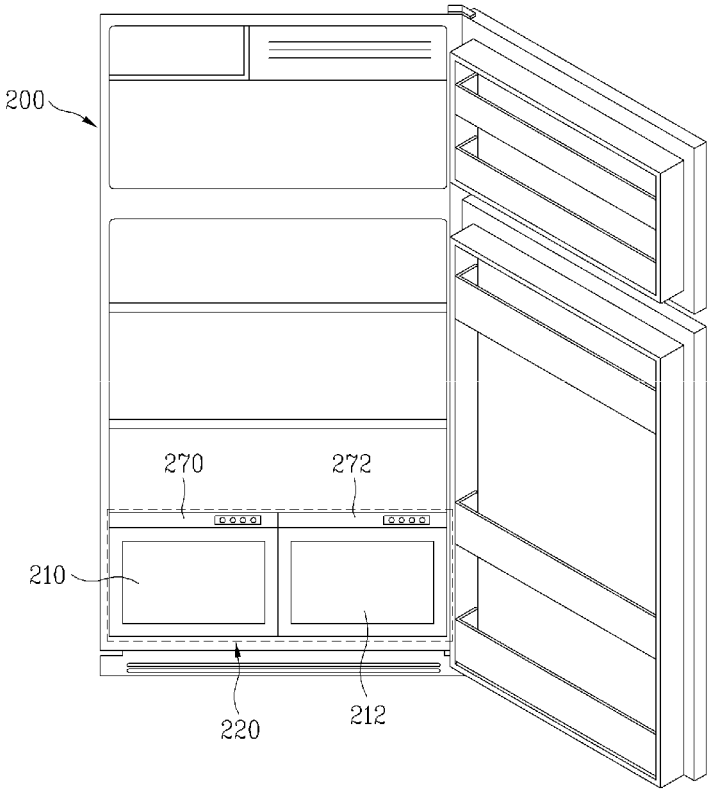
FIG. 12 is a perspective view showing a top-mount type refrigerator having a foodstuffs storage container in accordance with a first embodiment of the present invention.
Figure 13:
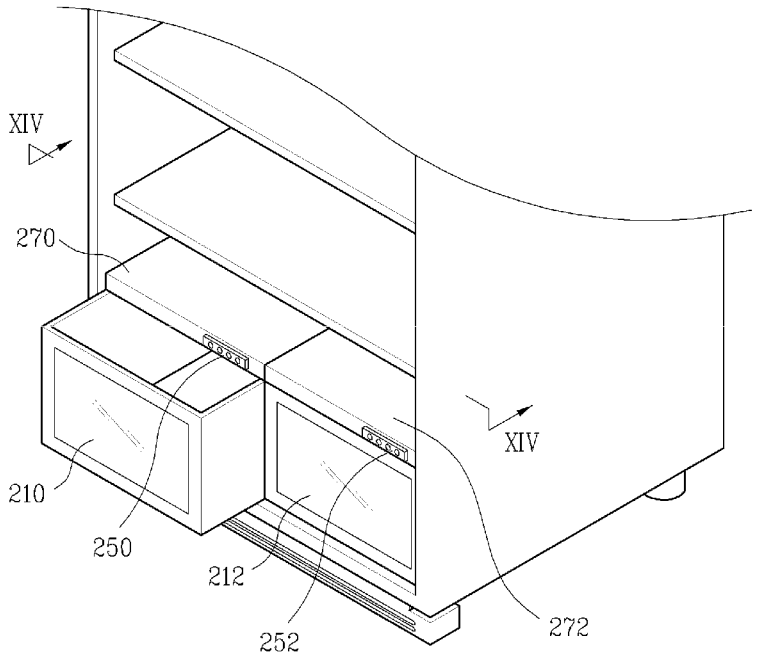
FIG. 13 is a perspective view showing a foodstuffs storage container in FIG. 12.

FIG. 12 is a perspective view showing a top-mount type refrigerator having a foodstuffs storage container, and FIG. 13 is an enlarged perspective view showing the foodstuffs storage container in FIG. 12.

As shown in FIGS. 12 and 13, this embodiment relates to a top-mount type refrigerator 200 in which a freezing chamber is positioned at an upper portion, a cooling chamber is positioned at a lower portion, and a foodstuffs storage container 220 is provided at a bottom portion of the cooling chamber.

The foodstuffs storage container 220 includes two storage chambers 210 and 212 which are partitioned in left and right directions.

Figure 14:
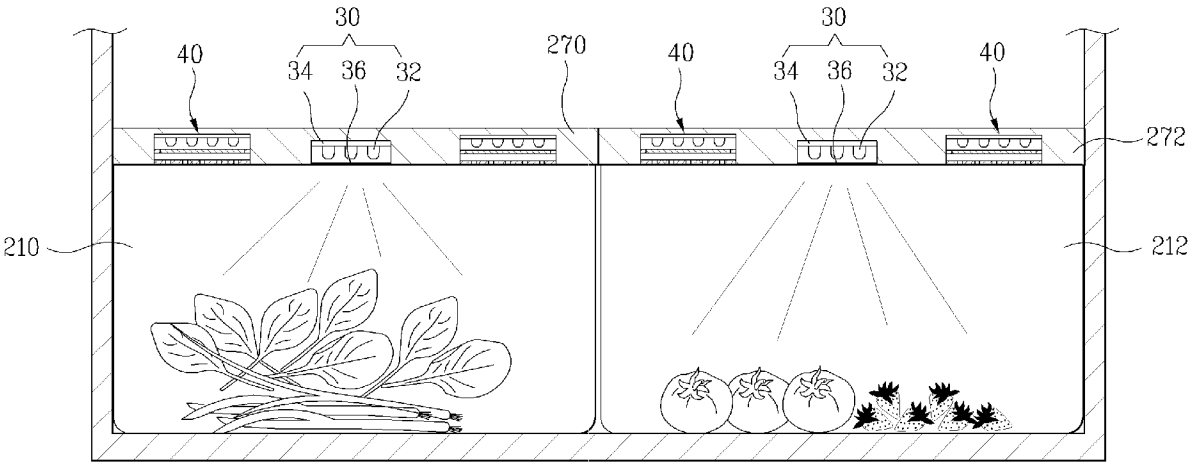
FIG. 14 is a sectional view taken along line XIV-XIV in FIG. 13.

FIG. 14 is a sectional view taken along lint XIV-XIV in FIG. 13.

Referring to FIG. 14, Chinese cabbage and green onion belonging to the green foodstuffs are stored in the first storage chamber 210, and tomato and strawberry belonging to the red foodstuffs are stored in the second storage chamber 212. Irradiation devices 30 for irradiating light within the visible light region into the storage chambers 210 and 212 and input parts 250 and 252 (see FIG. 13) for inputting information of color of the stored foodstuffs and changing the emitting color of light emitted from the irradiation devices 30 correspondingly to the color of the stored foodstuffs are mounted to the respective storage chambers 210 and 212.

As shown in FIG. 14, similarly to the previous embodiment illustrated in FIG. 9, the irradiation devices 30 are disposed at center portions of upper panels 270 and 272 which are provided at upper portions of the storage chambers 210 and 212. However, the irradiation devices 30 may be scatteredly arranged with a predetermined distance therebetween in width and length directions over the upper panels 270 and 272 (refer to FIG. 10). Also, the irradiation devices 30 may be mounted to outer rear portions of the storage chambers 210 and 212, and light is irradiated into the storage chambers 210 and 212 by penetrating through side walls of the storage chambers 210 and 212 (refer to FIG. 11).

Hereinafter, the operational effect of the above-structured refrigerator having the foodstuffs storage container according to the present invention will be described.

The user classifies the foodstuffs by colors, and puts the classified foodstuffs into the respective storage chambers. The light within the visible light region is irradiated into the respective storage chambers in which the foodstuffs classified by colors are respectively stored. At this time, the emitting color of the light irradiated into the storage chambers is decided correspondingly to the color of the foodstuffs stored in the storage chambers. Also, the optical deodorization modules execute the operations if deodorizing and sterilizing the air in the storage chambers.

Also, by using the input parts, the user can input the information of the color of the stored foodstuffs and change the emitting color of the light correspondingly to the color of the stored foodstuffs. Furthermore, the user can easily optionally operate the optical deodorization modules and the irradiation devices by use of the input parts.

Figure 15:
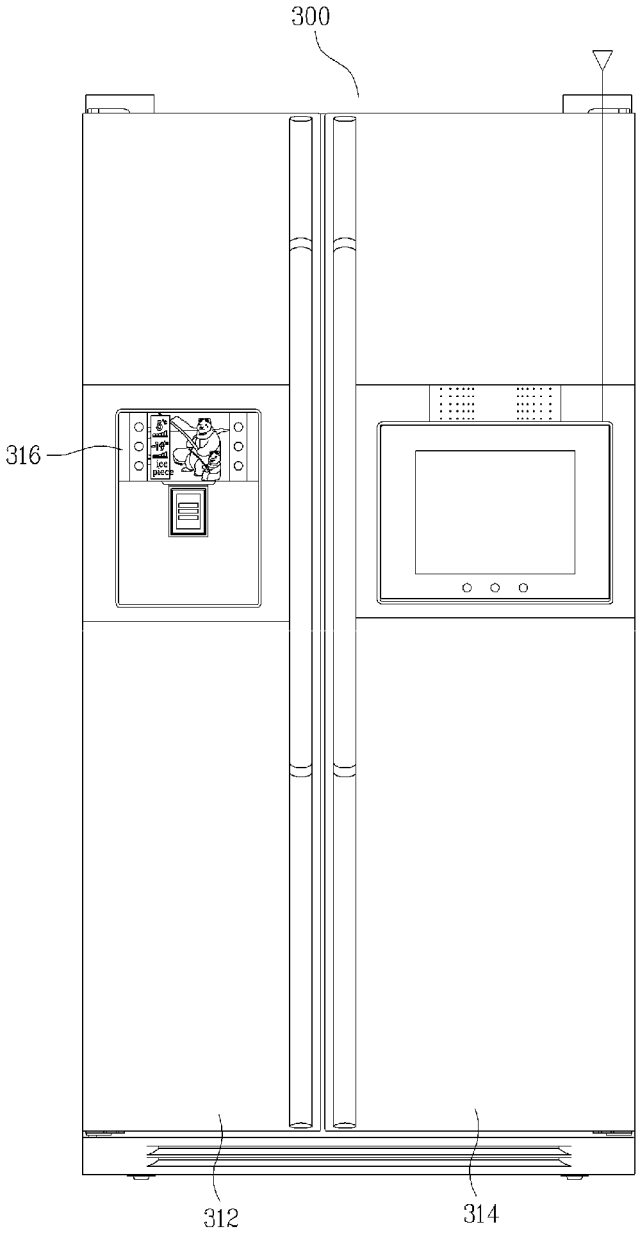
FIG. 15 is a front view showing an external appearance of a refrigerator having a meats/fishes storage chamber in accordance with a second embodiment of the present invention.

FIG. 15 is a front view showing an external appearance of a refrigerator having a meats/fishes storage chamber in accordance with a second embodiment of the present invention.

As shown in FIG. 15, a refrigerator 300 of this embodiment includes a pair of doors 312 and 314 which are hingedly coupled to two opposite front sides of a main body. The door 312 is a freezing chamber door, and the other door 314 is a cooling chamber door.

A display part 316 for displaying the operating state of the refrigerator 300 is mounted to the outer surface of the freezing chamber door 312. Although it is illustrated in the drawing that the display part 316 is mounted to the freezing chamber door 312, it is not restricted thereto. The display part 316 may be mounted to the cooling chamber door 314.

The display part 316 has a function of informing the user of the operating information of the freezing chamber 320 (see FIG. 16) and the cooling chamber 322 (see FIG. 16), e.g., the temperature, the humidity and the like in the chambers 320 and 322. Further, the refrigerator 300 of this embodiment can display the information about a meats/fishes storage chamber 330 through the display part 316, which will be described in detail later.

Figure 16:
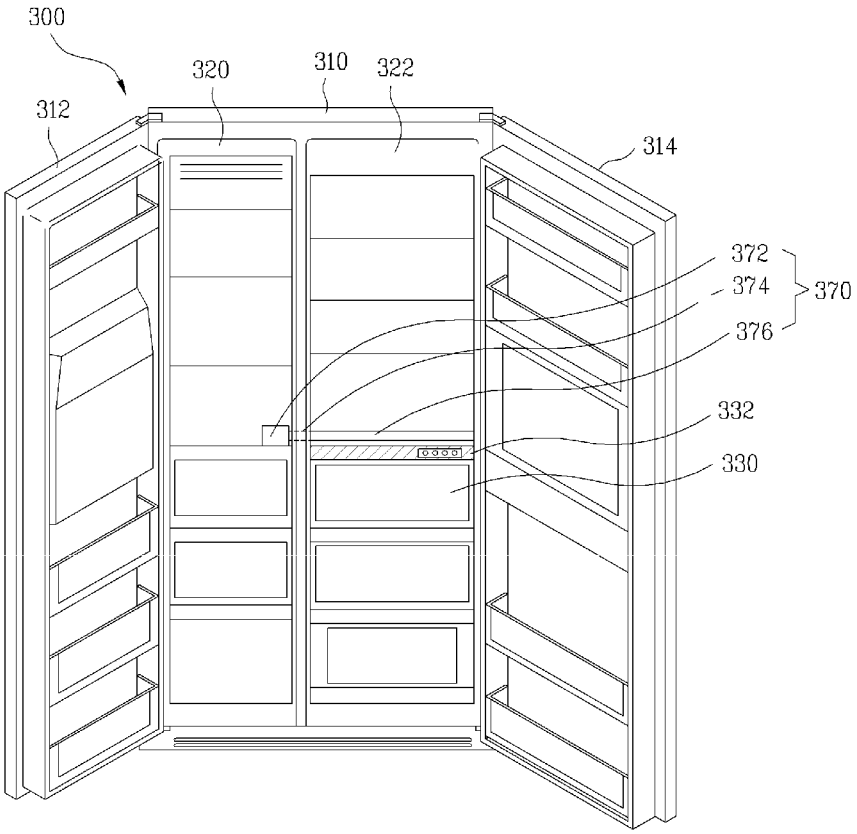
FIG. 16 is a front view showing an inner structure of a refrigerator in FIG. 15.
Figure 17:
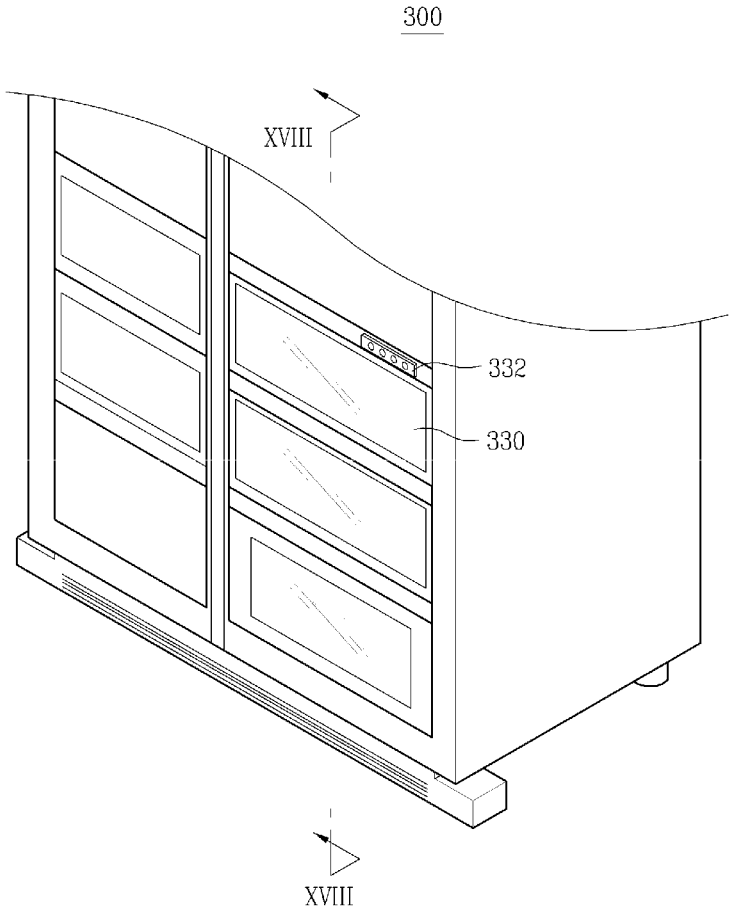
FIG. 17 is an enlarged perspective view showing a meats/fishes storage chamber of a refrigerator in FIG. 16.

FIG. 16 is a front view showing an inner structure of the refrigerator 300 in FIG. 15 when all the freezing chamber door 312 and the cooling chamber door 314 are opened, and FIG. 17 is an enlarged perspective view showing the meats/fishes storage chamber 330 of the refrigerator in FIG. 16.

The refrigerator 300 according to the second embodiment of the present invention includes a main body 310 which has the cooling chamber 322 and the freezing chamber 320, the meats/fishes storage chamber 330 which is provided in the cooling chamber 322, a visible light irradiation device 340 (see FIG. 18) which is mounted in the main body 310 and irradiates light within the visible light region into the meats/fishes storage chamber 330, and a control unit (not shown) which controls the visible light irradiation device 340. This embodiment exemplarily illustrates that the meats/fishes storage chamber of the present invention is applied to the side-by-side type refrigerator in which the cooling chamber and the freezing chamber are partitioned in the left and right directions, however, his is not restricted thereto. The meats/fishes storage chamber of the present invention can also be applied to other types of the refrigerator.

Referring to FIGS. 16 and 17, the freezing chamber 320 is formed at an inner left portion of the refrigerator 300, and the cooling chamber 322 is formed at an inner right portion of the refrigerator 300. And, the meats/fishes storage chamber 330 is provided at a middle portion of the cooling chamber 322. Although it is illustrated in the drawing that the meats/fishes storage chamber 330 is positioned at the middle portion of the freezing chamber 322, it is not restricted thereto. The meats/fishes storage chamber 330 may be provided at other adequate positions in the cooling chamber 322.

In this embodiment, the meats/fishes storage chamber 330 is opened and closed by a sliding type so that the user easily puts or pulls meats and fishes into/out of the meats/fishes storage chamber 330. However, the opening/closing type of the meats/fishes storage chamber 330 is not limited to the sliding type, and can be variously modified into other types like a door hingedly coupled to an upper portion of the meats/fishes storage chamber 330.

In order to prevent moisture from leaking, it is preferable to form the meats/fishes storage chamber 330 to be kept in an airtight state. By the airtight structure of the meats/fishes storage chamber 330, humidity in the meats/fishes storage chamber 330 can be adequately maintained for a long period.

An upper panel 332 is provided at an upper portion of the meats/fishes storage chamber 330, and a visible light irradiation device 340 is mounted to the upper panel 332 to irradiate visible light into the meats/fishes storage chamber 330. In this embodiment, although it is illustrated in the drawing that the visible light irradiation device 340 is mounted to the upper panel 332 provided at the upper portion of the meats/fishes storage chamber 330, it is not restricted thereto. The visible light irradiation device 340 may be disposed at a side wall or other positions of the meats/fishes storage chamber 330.

Figure 18:
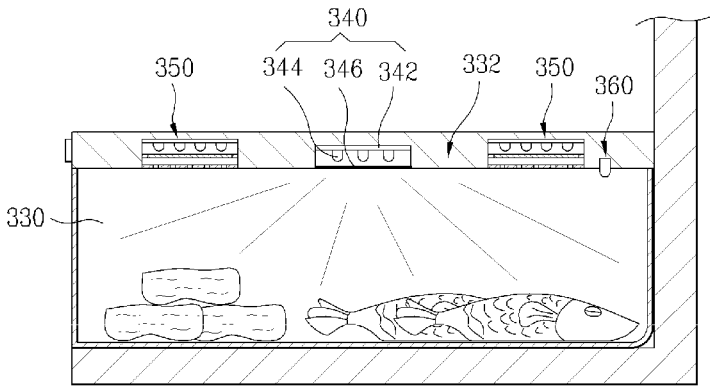
FIG. 18 is a sectional view taken along line XII-XII in FIG. 17.

FIG. 18 is a sectional view taken along line XII-XII in FIG. 17, which illustrates in detail the meats/fishes storage chamber 330 and the visible light irradiation device 340 mounted to the upper panel 332.

As shown in FIG. 18, the visible light irradiation device 340 is mounted to a lower surface of a center portion of the upper panel 332, and a control unit controls the visible light irradiation device 340 to irradiate visible light into the meats/fishes storage chamber 330.

The visible light irradiation device 340 includes a substrate 342, light emitting elements 344 mounted to the substrate 342, and a protective cover 346 for preventing permeation of moisture into the light emitting elements 344 and damage of the light emitting elements 344. Since the structure of the visible light irradiation device 340 of this embodiment is similar to that of the irradiation device 30 if the previous embodiment (refer to FIG. 4), the detailed description thereof will be omitted.

The visible light irradiation device 340 according to the present invention is configured to irradiate light or any one emitting color (preferably, yellow-white combined color) selected from the group consisting of blue, red-blue combined color and yellow-white combined color toward the meats and fishes stored in the meats/fishes storage chamber 330.

By experiments, the applicant of the present invention has found that the visible light of any one emitting color selected from the group consisting of blue, red-blue combined color and yellow-white combined color is effective to the maintenance of the freshness of meats and fishes, and above all, the yellow-white combined light is the most effective. Such an experimental result is illustrated in FIGS. 19 and 20.

Figure 19:
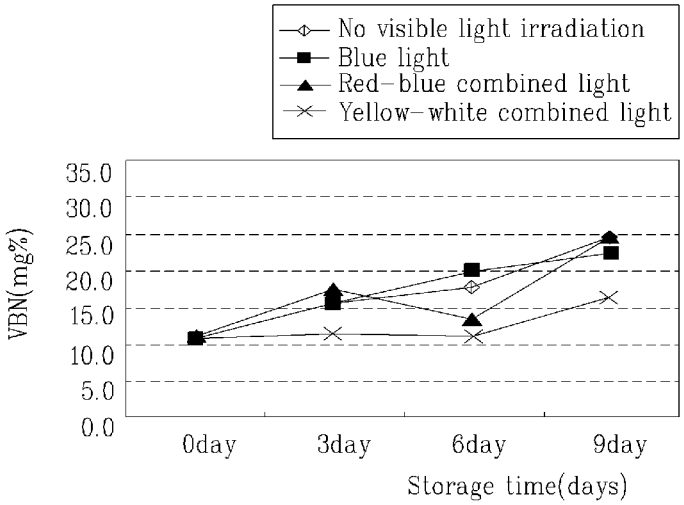
FIG. 19 is a graph showing freshness variations when irradiating visible light having different emitting colors to meats.
Figure 20:
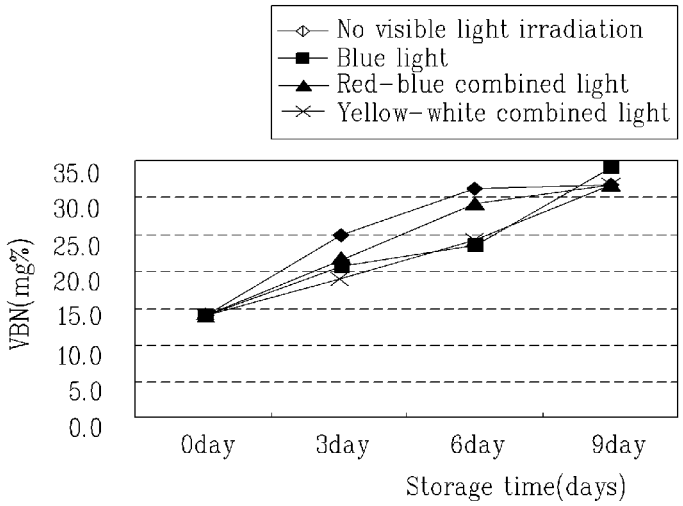
FIG. 20 is a graph showing freshness variations when irradiating visible light having different emitting colors to fishes.

FIGS. 19 and 20 are graphs showing freshness variations of the meats and fishes with the change of days when irradiating visible light of blue, red-blue combined color and yellow-white combined color to the meats and fishes. Here, the freshness is represented by a VBN (Volatile Basic Nitrogen) value of the meats and fishes. The VBN value means a value indicating an amount of volatile basic nitrogen like ammonia, amine or the like which is generated when protein foodstuffs rot. The higher VBN value means the lower freshness of the meats and fishes.

From the FIGS. 19 and 20, it can be seen that the VBN value when not irradiating visible light is increased higher than the VBN values when irradiating visible light of blue, red-blue combined color and yellow-white combined color as time lapses. Especially, it can be also seen that to irradiate visible light of yellow-white combined color is more effective to decrease the VBN value than to irradiate visible light of blue or red-blue combined color.

Accordingly, in this embodiment, the visible light of any one emitting color selected from the group consisting of blue, red-blue combined color and yellow-white combined color (most preferably, the visible light of yellow-white combined color) is irradiated to maintain the freshness of the meats and fishes stored in the meats/fishes storage chamber 330.

Referring again to FIG. 16, the refrigerator 300 of this embodiment may additionally have a cooling device 370 for cooling the meats/fishes storage chamber 330. The cooling device 370 may be provided separately from the main body 310.

The cooling device 370 for cooling the meats/fishes storage chamber 330 includes a first heat sink 372 which is mounted in the freezing chamber 320, and a second heat sink 376 which is mounted in the cooling chamber 322 and connected to the first heat sink 372.

The first heat sink 372 and the second heat sink 376 are communicatingly connected to each other by a heat pipe 374 which penetrates through a partition wall between the freezing chamber 320 and the cooling chamber 322. Cool air in the first heat sink 372 is transferred into the second heat sink 376 through the heat pipe 374. In other words, because the temperature in the freezing chamber 320 is typically kept lower than the temperature in the cooling chamber 322, the cool air in the first heat sink 372 mounted in the freezing chamber 320 is transferred into the second heat sink 376 mounted in the cooling chamber 322 through the heat pipe 374.

The second heat sink 376 is positioned adjacent to the meats/fishes storage chamber 330, and keeps the meats/fishes storage chamber 330 at a desired temperature by the cool air transferred from the first heat sink 372. It is preferable to dispose the second heat sink 376 above the meats/fishes storage chamber 330 so that the second heat sink 376 supplies the cool air downward.

When the second heat sink 376 is positioned above the meats/fishes storage chamber 330, i.e., above the upper panel 332, it is preferable that the upper panel 332 has a structure allowing the cool air from the second heat sink 376 to pass therethrough. For example, a plurality of through-holes may be formed at the upper panel 332, through which the cool air from the second heat sink 376 can pass. The second heat sink 376 may be mounted to a side wall of the meats/fishes storage chamber 330 to supply the cool air through the side wall. The second heat sink 376 positioned above the meats/fishes storage chamber 330 may formed in a plate type having a predetermined thickness or in a pin type having a plurality of pins so as to facilitate heat transfer to the meats/fishes storage chamber 330.

On the other hand, the control unit controls the cooling device 370 to keep the meats/fishes storage chamber 330 at a temperature of −1.5° C. to −2.5° C., preferably, −2.0° C. When keeping the meats/fishes storage chamber 330 at a temperature of −1.5° C. to −2.5° C. (preferably, −2.0° C., the meats and fishes can be kept in a more fresh state for a long period while being prevented from being completely frozen.

Figure 21:
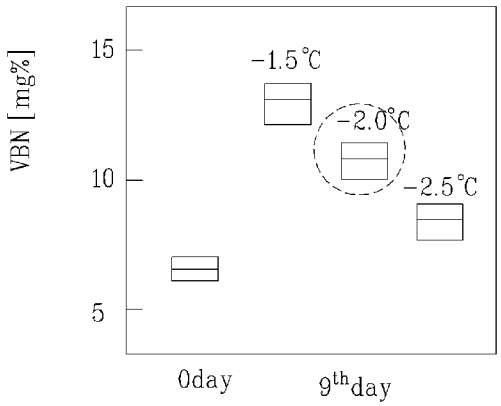
FIG. 21 is a graph showing freshness variations when meats and fishes are stored at different temperatures.

FIG. 21 is a graph showing a result of an experiment of measuring the VBN values when the meats and fishes are stored at different temperatures for a long period. As shown in FIG. 21, the lower the temperature is, the lower the VBN values are. Therefore, the lower temperature in the meats/fishes storage chamber is more effective to keep the meats and fishes in a more fresh state for a long period. However, if the temperature is kept excessively low, it is inconvenient and takes much time to thaw the frozen meats and fishes. Accordingly, in this embodiment, the control unit controls the cooling device 370 to keep the meats/fishes storage chamber 330 at a temperature of −2.0° C., so as to maintain the VBN value adequately while preventing the meats and fishes from being completely frozen.

Referring again to FIG. 18, in addition to the visible light irradiation device 340, an ultraviolet light irradiation device 350 for irradiating ultraviolet light into the meats/fishes storage chamber 330 and a freshness measuring device 360 for measuring the freshness of the meats and fishes are mounted to the upper panel 332. Antimicrobial material is coated on an inner surface of the meats/fishes storage chamber 330 to prevent microbial propagation.

Figure 22:
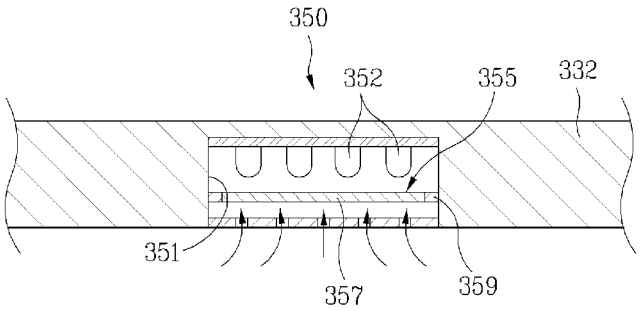
FIG. 22 is an enlarged sectional view showing an ultraviolet light irradiation device in FIG. 18.

The ultraviolet light irradiation device 350 is illustrated in detail in FIG. 22.

As shown in FIG. 22, the ultraviolet light irradiation device 350 of this embodiment has a difference from the optical deodorization module 40 depicted in FIG. 5, in that the ultraviolet light irradiation device 350 does not include a photocatalyst filter. The ultraviolet light irradiation device 350 includes UV-LEDs 352 which are mounted in an insertion portion 351 of the upper panel 332, and a sealing member 355 which prevents the moisture permeation into the insertion portion 351. Since the components of the ultraviolet light irradiation device 350 are the same as the components of the optical deodorization module 40 depicted in FIG. 5, the detailed description thereof will be omitted.

Meanwhile, the control unit controls the ultraviolet light irradiation device 350 to irradiate ultraviolet light with a predetermined period. The period of irradiating ultraviolet light can be adequately adjusted. For example, the ultraviolet light irradiation device 350 may be controlled to irradiate ultraviolet light or 1 minute at 120-minute intervals.

The antimicrobial material (not shown) coated on the inner surface of the meats/fishes storage chamber 330 prevents the propagation of microbes generated at the meats and fishes, thereby keeping the meats and fishes in a more fresh state. Preferably, the antimicrobial coating material is titanium dioxide ($TiO_2$), identical to the above-described photocatalyst filter 43 depicted in FIG. 6. Since the sterilizing and deodorizing performances of titanium dioxide ($TiO_2$) are described above, the detailed description thereof will be omitted. When the ultraviolet light irradiation device 350 irradiates ultraviolet light to titanium dioxide ($TiO_2$) coating material, the optical deodorizing performance is executed, thereby sterilizing and deodorizing the air in the meats/fishes storage chamber 330.

Referring again to FIG. 18, the freshness measuring device 360 for measuring the freshness of the meats and fishes stored in the meats/fishes storage chamber 330 is mounted to the upper panel 332.

Various devices for measuring the freshness of meats and fishes are already well known. In this embodiment, a VBN sensor for detecting the VBN value or an infrared sensor is used as the freshness measuring device 360. The VBN sensor measures the freshness of meats and fishes by detecting the VBN value, and the infrared sensor measures the freshness of meats and fishes by using infrared light. Hereinafter, the VBN sensor as the freshness measuring device 360 will be described.

The freshness measuring device 360 using the VBN sensor detects the VBN value in the meats/fishes storage chamber 330, and the detecting result from the freshness measuring device 360 is displayed on the display part 316 (see FIG. 15) by the control unit (not shown). Based on the VBN value displayed on the display part 316, the user can easily know the freshness of the meats and fishes stored in the meats/fishes storage chamber 330.

When the control unit determines that the detected VBN value from the freshness measuring device 360 reaches a first limit value, the control unit controls the display part 316 to display a warning message. When the control unit determines that the detected VBN value reaches a second limit value, the control unit automatically controls the cooling device 370 to freeze the meats and fishes stored in the meats/fishes storage chamber 330.

Describing in detail, when the freshness of the meats and fishes stored in the meats/fishes storage chamber 330 is deteriorated to such an extent that the VBN value is increased to the predetermined first limit value or more, the control unit transmits the warning message to the user through the display part 316, so that the user can select whether to consume or freeze the meats and fishes. In spite of the warning message, when the user leaves the meats and fishes as they are and the freshness of the meats and fishes is further deteriorated to such an extent that the VBN value is increased to the predetermined second limit value or more, the control unit controls the cooling device 370 to freeze the meats and fishes stored in the meats/fishes storage chamber 330 to prevent further deterioration of the freshness.

The first and second limit values may be preset by a refrigerator manufacturer. In this embodiment equipped with the VBN sensor, the first limit value corresponds to the VBN value of 15 mg %, and the second limit value corresponds to the VBN value of 20 mg %. However, the first and second limit values are not restricted to the above VBN values, and may be allotted with other adequate VBN values.

As described above, when the detected VBN value is the second limit value or more, the control unit controls the cooling device 370 to freeze the inside of the meats/fishes storage chamber 330. When freezing the inside of the meats/fishes storage chamber 330, the control unit controls the cooling device 370 so that the temperature in the meats/fishes storage chamber 330 is kept below −2.5° C. Because the meats and fishes generally get frozen below −2.5° C., further deterioration of the freshness of the meats and fishes is prevented.

On the other hand, when the VBN value detected by the freshness measuring device 360 is a specific limit value or more, although the operating state of the ultraviolet light irradiation device 350 does not correspond to the light emitting mode, the control unit controls the ultraviolet light irradiation device 350 to irradiate ultraviolet light.

In other words, when measuring the freshness of the meats and fishes stored in the meats/fishes storage chamber 330 by use of the VBN sensor, if the control unit determines that the VBN value is the specific limit value or more, the control unit controls the ultraviolet light irradiation device 350 to irradiate ultraviolet light although the operating state of die ultraviolet light irradiation device 350 does not correspond to the light emitting mode.

The specific limit value may be preset by a refrigerator manufacturer. For example, the specific limit value may be either the aforesaid first limit value or the second limit value, or may be a different value from the first and second limit values.

Hereinafter, a method of storing meats and fishes in the refrigerator structured as above will be described.

If the user puts meats and fishes into the meats/fishes storage chamber 330 of the refrigerator 300, the control unit controls the visible light irradiation device 340 to irradiate visible light into the meats/fishes storage chamber 330, and controls the cooling device 370 to cool the meats/fishes storage chamber 330 at a desired temperature.

The visible light irradiation device 340 is controlled to irradiate light of any one emitting color (preferably, yellow-white combined color) selected from the group consisting of blue, red-blue combined color and yellow-white combined color into the meats/fishes storage chamber 330.

The cooling device 370 is controlled to keep the meats/fishes storage chamber 330 at a temperature of −1.5° C. to −2.5° C. (preferably, −2.0° C.).

Also, the control unit controls the ultraviolet light irradiation device 350 to irradiate ultraviolet light into the meats/fishes storage chamber 330 with a predetermined period. Preferably, the ultraviolet light irradiation device 350 is controlled to irradiate ultraviolet light for 1 minute at 120-minute intervals.

While the ultraviolet light irradiation device 350 irradiates ultraviolet light into the meats/fishes storage chamber 330 with the predetermined period, the control unit controls the display part 316 to display the result detected by the freshness measuring device 360 mounted to the meats/fishes storage chamber 330. When the detected value is the first limit value or more, the control unit transmits the warning message to the user through the display part. When the detected value is the second limit value or more, the control unit controls the cooling device 370 to freeze the meats and fishes stored in the meats/fishes storage chamber 330 to prevent further deterioration of the freshness.

When the detected value is the specific limit value or more, although the operating state of the ultraviolet light irradiation device 350 does not correspond to the light emitting mode, the control unit may control the ultraviolet light irradiation device 350 to irradiate ultraviolet light. The above specific limit value may be either the aforesaid first limit value or the second limit value, or may be a different value from the first and second limit values.

INDUSTRIAL APPLICABILITY

As apparent from the above description, the refrigerator according to the present invention is configured to separately store the foodstuffs classified by colors and irradiate the most adequate light for the color of the stored foodstuffs, thereby maximizing the effects of maintaining the freshness of the foodstuffs and preventing the decrease of chlorophyll concentration.

Also, the refrigerator according to the present invention presents the user with the clear reference by which the foodstuffs are classified and stored in the respective storage chambers. Therefore, the effect of partitioning the foodstuffs storage container into a plurality of storage chambers can be increased.

Also, since the user can input the information of the color of the stored foodstuffs, the emitting color of the light irradiated to the stored foodstuffs is selected adequately for the color of the foodstuffs.

Also, because the clear and intuitive reference for selecting the emitting color of the light irradiated to the stored foodstuffs is provided, the user can easily select the emitting color of the light and trust the effects by the irradiation device.

Also, because the optical deodorization module sterilizes and deodorizes the air in the foodstuffs storage chambers, the effect of maintaining the freshness of the foodstuffs can be increased.

Also, because the visible light is irradiated into the meats/fishes storage chamber and the meats/fishes storage chamber is controlled to be kept at a predetermined temperature, the meats and fishes can be stored in a more fresh state in the meats/fishes storage chamber for a long period.

Also, when the detected value indicating the freshness of the meats and fishes is the first limit value or more, the control unit transmits the warning message to the user, and when the detected value is the second limit value or more, the control unit controls the cooling device to freeze the meats and fishes stored in the meats/fishes storage chamber, thereby preventing further deterioration of the freshness.

Also, by irradiating ultraviolet light into the meats/fishes storage chamber with a predetermined period, deterioration of the freshness of the meats and fishes can be additionally prevented.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

The invention claimed is:

1. A refrigerator comprising:

a main body which has a cooling chamber and a freezing chamber;

a storage chamber which is provided in the cooling chamber to store foodstuffs;

an irradiation device which irradiates light within a visible light region correspondingly to color of the foodstuffs stored in the storage chamber, the irradiation device configured to operate when a door of the refrigerator is closed;

an optical deodorization module which includes an ultraviolet light irradiation device which is mounted to the storage chamber to irradiate ultraviolet light and a photocatalyst filter which receives the ultraviolet light from the ultraviolet light irradiation device and is coated with a photocatalyst agent;

a control unit which controls the irradiation device and the ultraviolet light irradiation device; and an input part provided at a front side of the upper panel for inputting information of the color of the foodstuffs stored in the storage chamber, wherein the irradiation device has a white light source, a red light source and a green light source, and is configured to irradiate light having a color combining white and one color selected from red and green which corresponds to the color of the foodstuffs according to the information input to the input part.

2. The refrigerator according to claim 1, wherein the ultraviolet light irradiation device includes ultraviolet light emitting diodes.

3. The refrigerator according to claim 1, wherein the photocatalyst filter is mounted to the storage chamber, and formed in a mesh type which is coated with a titanium dioxide photocatalyst solution.

4. The refrigerator according to claim 1, wherein the photocatalyst filter is mounted to the storage chamber, and formed in a plate type which is coated with a titanium dioxide photocatalyst solution and formed with a plurality of through-holes.

5. The refrigerator according to claim 1, wherein the irradiation device is a light emitting diode.

6. The refrigerator according to claim 1, wherein when the information of the color of the foodstuffs inputted to the input part is red, the control unit controls the irradiation device to irradiate red light with white light.

7. The refrigerator according to claim 1, wherein when the information of the color of the foodstuffs inputted to the input part is green, the control unit controls the irradiation device to irradiate green light with white light.

8. The refrigerator according to claim 1, further comprising:

a color recognition device which recognizes the color of the foodstuffs stored in the storage chamber, wherein the control unit controls the irradiation device to irradiate light within the visible light region correspondingly to the color of the foodstuffs in response to a signal from the color recognition device.

9. The refrigerator according to claim 1, wherein the irradiation device including light emitting diodes is insertedly mounted in a rear partition wall of the main body behind the storage chamber, and wherein the light emitting diodes irradiate light through a translucent side wall of the storage chamber.

10. The refrigerator according to claim 1, wherein the irradiation device includes light emitting diodes, wherein the ultraviolet light irradiation device includes at least one ultraviolet light emitting diode, and wherein the control unit controls the irradiation device and the ultraviolet light irradiation device to irradiate visible light or ultraviolet light into the storage chamber alternately with a predetermined period.

11. A refrigerator comprising:

a main body which has a cooling chamber and a freezing chamber;

a meats/fishes storage chamber which is provided in the cooling chamber and coated with antimicrobial material to prevent microbial propagation;

a visible light irradiation device which irradiates visible light into the meats/fishes storage chamber, the visible light irradiation device configured to operate when a door of the refrigerator is closed;

a control unit which controls the irradiation device;

a freshness measuring device which detects a value indicating freshness of meats and fishes stored in the meats/fishes storage chamber; and a display part which displays the freshness value of the meats and fishes detected by the freshness measuring device, wherein the visible light irradiation device has a blue light source, a red light source, a yellow light source and a white light source, and is configured to irradiate light of any one emitting color selected from the group consisting of blue, red-blue combined color and yellow-white combined color into the meats/fishes storage chamber.

12. The refrigerator according to claim 11, wherein the visible light irradiation device includes at least one light emitting diode.

13. The refrigerator according to claim 11, wherein the antimicrobial material is titanium dioxide.

14. The refrigerator according to claim 11, further comprising:

an ultraviolet light irradiation device which irradiates ultraviolet light into the meats/fishes storage chamber, wherein the control unit controls the display part and the ultraviolet light irradiation device.

15. The refrigerator according to claim 14, wherein the freshness measuring device is a volatile basic nitrogen (VBN) sensor.

16. The refrigerator according to claim 14, wherein the freshness measuring device is an infrared sensor.

17. The refrigerator according to claim 14, wherein the control unit controls the ultraviolet light irradiation device to irradiate ultraviolet light into the meats/fishes storage chamber with a predetermined period.

18. The refrigerator according to claim 17, wherein the control unit is connected to the freshness measuring device, and wherein when the value detected by the freshness measuring device is a specific limit value or more, although an operating state of the ultraviolet light irradiation device does not correspond to a light emitting mode, the control unit controls the ultraviolet light irradiation device to irradiate ultraviolet light.

19. The refrigerator according to claim 14, further comprising:

a cooling device which cools the meats/fishes storage chamber, wherein the control unit controls the cooling device.

20. The refrigerator according to claim 19, wherein the control unit controls the cooling device to keep the meats/fishes storage chamber at a temperature of −1.5 C. to −2.5 C.

21. The refrigerator according to claim 19, wherein the control unit controls the cooling device to keep the meats/fishes storage chamber at a temperature of −2.0 C.

22. The refrigerator according to claim 19, wherein the cooling device includes a first heat sink which is mounted in the freezing chamber, and a second heat sink which is mounted in the cooling chamber and connected to the first heat sink, the second heat sink being kept below a predetermined temperature by cool air transferred from the first heat sink and supplying the cool air into the meats/fishes storage chamber.

23. The refrigerator according to claim 22, wherein the first heat sink and the second heat sink are formed in a plate type.

24. The refrigerator according to claim 22, wherein the first heat sink and the second heat sink are formed in a pin type.

25. The refrigerator according to claim 22, wherein the second heat sink is positioned above the meats/fishes storage chamber.

26. The refrigerator according to claim 14, wherein when the value detected by the freshness measuring device is a predetermined limit value or more, the control unit controls the display part to display a warning message.

27. The refrigerator according to claim 14, further comprising:

a cooling device which cools the meats/fishes storage chamber, wherein when the value detected by the freshness measuring device is a predetermined limit value or more, the control unit controls the cooling device to freeze the meats and fishes stored in the meats/fishes storage chamber.

28. The refrigerator according to claim 14, further comprising:

a cooling device which cools the meats/fishes storage chamber, wherein when the value detected by the freshness measuring device is a predetermined first limit value or more, the control unit controls the display part to display a warning message, and when the value detected by the freshness measuring device is a predetermined second limit value or more, the control unit controls the cooling device to freeze the meats and fishes stored in the meats/fishes storage chamber.

* * * * *

UNITED STATES PATENT AND TRADEMARK OFFICE

CERTIFICATE OF CORRECTION

PATENT NO. : 8,813,516 B2
APPLICATION NO. : 12/091909
DATED : August 26, 2014
INVENTOR(S) : Deul Re Min et al.

It is certified that error appears in the above-identified patent and that said Letters Patent is hereby corrected as shown below:

ON THE TITLE PAGE:

At item (30), Foreign Application Priority Data, change:

"Oct. 2, 2006 (KR) ..... 10-2005-0097116"

to --Oct. 2, 2006 (KR) ..... 10-2006-0097116--.

Signed and Sealed this
Twenty-third Day of December, 2014

Michelle K. Lee

Michelle K. Lee
*Deputy Director of the United States Patent and Trademark Office*